United States Patent [19]

Bentsen et al.

[11] Patent Number: 4,793,487

[45] Date of Patent: Dec. 27, 1988

[54] DISPENSING OF BAGS INITIALLY JOINED HEAD-TO-HEAD

[75] Inventors: Per Bentsen, Suffern, N.Y.; Robert S. Nocek, Stamford, Conn.; Steven Ausnit, New York, N.Y.

[73] Assignee: Minigrip, Inc., Orangeburg, N.Y.

[21] Appl. No.: 914,930

[22] Filed: Oct. 3, 1986

[51] Int. Cl.[4] ..... B65D 85/48; B65D 3/26

[52] U.S. Cl. ..... 206/451; 206/602; 206/813; 206/607; 206/609; 206/616

[58] Field of Search ..... 206/813, 602, 449, 806, 206/451, 606, 607, 609, 616

[56] References Cited

U.S. PATENT DOCUMENTS

| | | | |
|---|---|---|---|
| 2,967,610 | 1/1961 | Ebert et al. | 206/602 |
| 3,090,483 | 5/1963 | Altree et al. | 206/602 |
| 3,113,673 | 12/1963 | Stein | 206/813 |
| 3,160,341 | 12/1964 | Chekney | 206/813 |
| 3,209,941 | 10/1965 | Krake | 206/449 |
| 3,215,332 | 11/1965 | Bess | 206/602 |
| 3,226,010 | 12/1965 | Rogers, Jr. | 206/602 |
| 3,362,616 | 1/1968 | Van Dyck | 206/602 |
| 4,256,223 | 5/1981 | Pawlowski | 206/602 |
| 4,377,237 | 3/1983 | Panlowski | 206/602 |
| 4,421,267 | 12/1983 | Wischoff | 206/806 |

*Primary Examiner*—Joseph Man-Fu Moy

*Attorney, Agent, or Firm*—Hill, Van Santen, Steadman & Simpson

[57] ABSTRACT

A container dispenser assembly containing stacks of flat bags with their tops adjacent and releasably interconnected and held in a rectangular cardboard container having a central tear strip extending over three walls with the tear strip removable and the separated sections of the container foldable about a fourth wall. In one form a thread is anchored within the container to be drawn between the tops of the bags and separate them. When the container is folded open, the bags may be withdrawn one by one from the two halves of the container.

6 Claims, 2 Drawing Sheets

DISPENSING OF BAGS INITIALLY JOINED HEAD-TO-HEAD

BACKGROUND OF THE INVENTION

The invention relates to improvements in containers for stacked items and more particularly to an improved dispensing container which holds and protects the items and is readily separated to provide ready access to the items for removing individual items from the container.

More particularly, the invention relates to a container and dispenser especially well suited for reclosable plastic bags. While the features of the invention are particularly useful in the packaging and dispensing of small individual plastic bags made of a slippery plastic material, and the disclosure contained herein will be primarily directed to a description of packaging and dispensing this type of item, it will be appreciated by those versed in the art upon reviewing the disclosure that certain features of the invention may be used for packaging and dispensing other items.

In the development of inexpensive reclosable plastic bags, such bags are used for a multitude of purposes and improved manufacturing techniques and structures have reduced the cost of the bags so that they are used for many purposes and in many circumstances. For example, such bags may be used individually by a householder having the bags available in the kitchen or workroom. Also, the bags may be used in merchandising such as in a retail store where individual bags are used for packaging hardware items such as nuts and bolts or are used for packaging foodstuffs.

For these uses, the bags are conveniently contained and shipped in cartons and a number of problems in handling are present. The bags usually being formed of a plastic such as polyethylene are slippery and must be contained so as to be easily handled prior to usage. Generally, banding or handling which distorts the bags is not the best solution and it is useful to package the bags so that they retain their original flat undistorted shape.

Further, it is desirable that when the bags are received by the user, they can be utilized one by one and a means of dispensing individual bags is desirable. If the user can remove the bags one at a time from a holder without disturbing the shape or containment of the other bags, such packaging is desirable.

It is accordingly an object of the present invention to provide an improved method and structure for packaging stackable items such as plastic bags wherein the package holds and protects the bags in their lay-flat undistorted shape and can be easily opened for removal of the bags.

A further object of the invention is to provide a structure and a method for containing stackable items such as plastic bags which provides a protective enclosure and a means of handling the bags until use and additionally provides a means for dispensing the bags whereby they can be readily accessible and individually withdrawable from the container.

A feature of the invention is the provision of a rectangular container for bags which has a tear strip extending around the center and wherein the container holds two opposed stacks of bags with their tops adjacent each other. In a preferred form the tops are interconnected and the container is arranged such that a separating thread is contained in the container which can be simultaneously drawn through the center of the stacks of bags to separate them as the container is opened. A further feature is the provision of such container which continues to keep the bags arrayed in their stacked fashion after it is opened and additionally provides free access to individual bags by exposing their edges so that they can be independently and individually drawn from the halves of the opened container. The container is arranged so that it readily sets on a counter or flat space and provides a dispenser as well as a retainer for the stacks of bags permitting withdrawal individually or in plural numbers for the user.

Other objects, advantages and features will become more apparent with the teaching of the principles of the invention in connection with the disclosure of the preferred embodiments thereof in the specification, claims and drawings, in which:

DESCRIPTION

Figure 1:
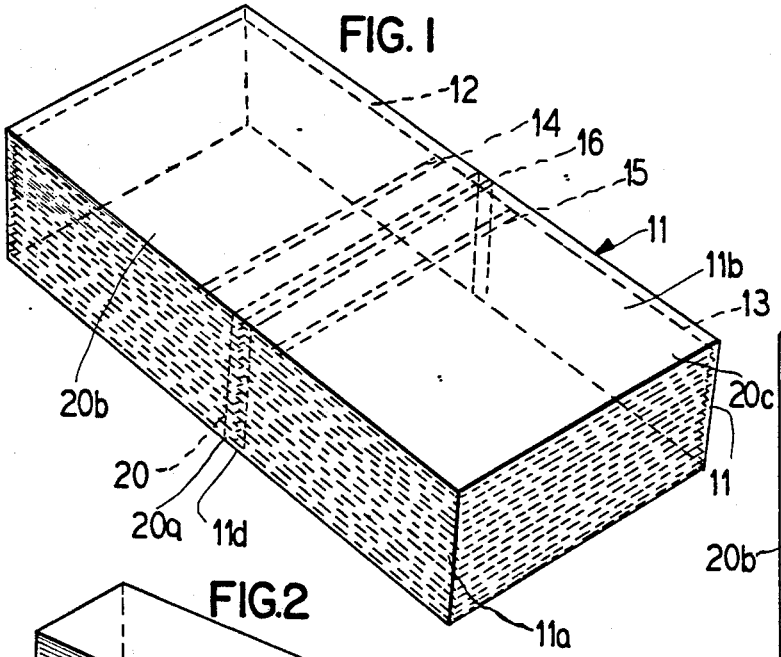
FIG. 1 is a perspective view of a container holding plastic bags or like items in accordance with the principles of the invention.

As illustrated in FIG. 1, a container or carton 11 is provided for housing bags shown in broken line at 12 and 13. The bags are arranged in parallel stacks with their top ends meeting at 16. The bags are of the type which are openable and reclosable and have a rib and groove zipper element adjacent the top as shown at 14 for the stack of bags 12 and at 15 for the stack of bags 13.

The carton 11 is of board or other semi-rigid material and is of a size to tightly enclose the bags 12 and 13. The bags being of polyethylene or similar plastic material are slippery so that the carton has an interior dimension substantially equal or only slightly larger than the outer dimension of the bags to hold them in their oriented stacks. The carton can thus be handled for packing in larger cartons for shipping and for usage without losing the orientation of the stacked bags within. Even if the carton is tossed or dropped, the bags will remain in their position within the carton and heavy handling or usage with a denting of the carton will not adversely affect the carton which is to be opened at the time the bags are to be used.

Extending along three walls of the carton is a frangible line or strip 20. In a preferred form, the frangible strip is a tear strip which can be grasped by a tab at one end 20*a* and torn from the carton to separate it into two equal sections 20*b* and 20*c* which can be seen better in FIG. 4. The container has a first wall 11*a*, a second wall 11*b* and a third wall 11*c* across which the tear strip 20 extends. The fourth wall, shown on the underside of FIG. 1 at 11*d* has a fold line 18 which is aligned with the ends of the tear strip so that the sections 20*b* and 20*c* of the carton can be folded back after the removal of the tear strip.

Figure 4:
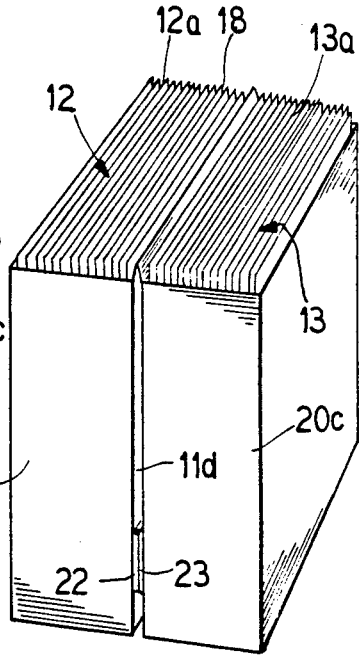
FIG. 4 is a perspective view of the container of FIG. 1 opened for dispensing bags.

After the tear strip is torn from the three sides of the container 11, the two equal sections are folded back along the fold line 18 to assume the position shown in FIG. 4. The stacks 12 and 13 of bags are then exposed with their tops projecting a short distance from the two sections 20*b* and 20*c* of the carton. The removal of the tear strip 20 provides the exposure of the ends of the bags which are at the location shown at 16 in FIG. 1.

Figure 2:
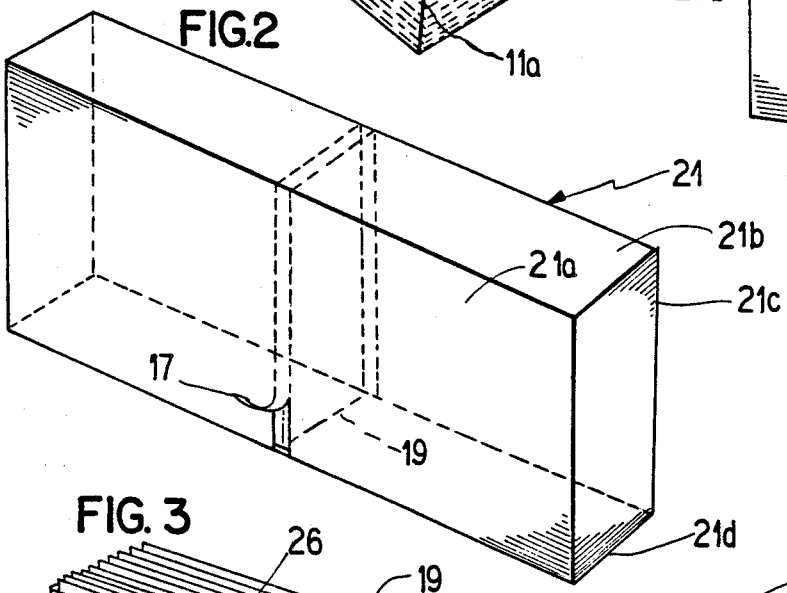
FIG. 2 is a perspective view in slightly modified form of the invention.

In the arrangement of FIG. 1, and in the arrangement of FIG. 2, the bags are in two separate stacks with their tops merely touching each other or lightly connected so that when the sections of the cartons are folded back, the tops of the bags separate.

Since the bags are of very slippery material, the tops can be individually gripped as they appear in FIG. 4, and individually pulled from the container 11. The bags can then be pulled either individually or in any number that the user wishes to use and the carton will provide a servicing dispensing container for the remaining bags. The bags can be pulled from either side of the carton and it provides a stable erect container and dispenser for the bags.

If desired, the two sections of the carbon can be secured to each other along the confronting faces of the wall 11*d*. Attaching means are provided such as strips of adhesive tape 22 and 23 for securing the contronting faces 11*d*.

Figure 3:
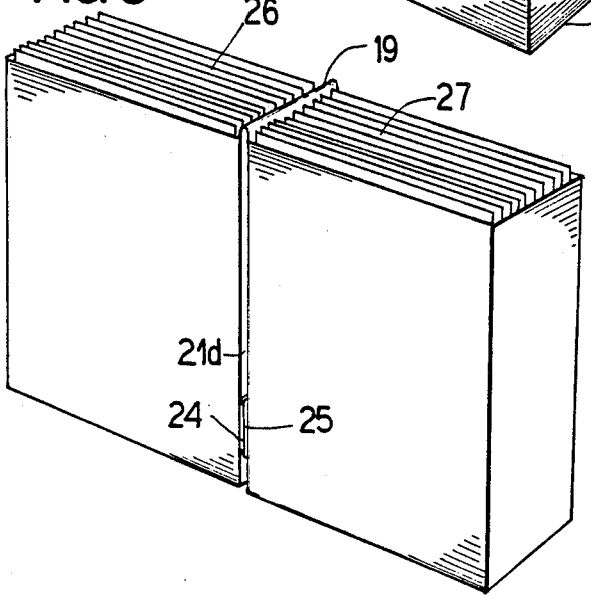
FIG. 3 is a perspective view of the container shown in FIG. 2 opened for dispensing bags.

In the arrangement of FIG. 2, a carton 21 is arranged similar to that of FIG. 1 but with a fold line 19 on a different surface so that when the carton is opened, the stacks of bags 26 and 27 therein are situated lengthwise relative to each other. For this purpose, a fold line 19, FIG. 2, is provided along a narrow face 21*d* of the carton. A tear strip 17 extends along three faces of the carton, namely faces 21*a*, 21*b* and 21*c*. When the tear strip 17 is torn from the carton, it separates it into two sections and the sections are folded back along the fold line 19 to provide a dispensing container arrangement as shown in FIG. 3. Attaching means shown in the form of adhesive tapes 24 and 25 may be provided for securing the confronting faces 21*d* to each other, FIG. 3.

Figure 5:
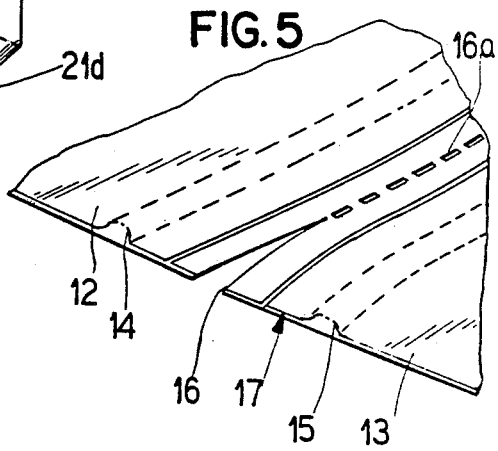
FIG. 5 is an enlarged fragmentary perspective view of the connection between the tops of the bags which are held within the container.

While the tops of the bags 26 and 27 may be lightly attached or not attached in the arrangement of FIG. 3, the bag arrangements can be arranged so that the tops of the bags are attached such as by perforations 16*a* shown in FIG. 5. The breaking open of the carton, after removing the tear strip 17, will normally tear the bags along their top separation line 16, FIG. 5, or a cutting means may be provided to complete the separation of the bags from their parallel stacks. In FIG. 5 the stacks are shown at 12 and 13 with their top edges shown at 16.

Figure 6:
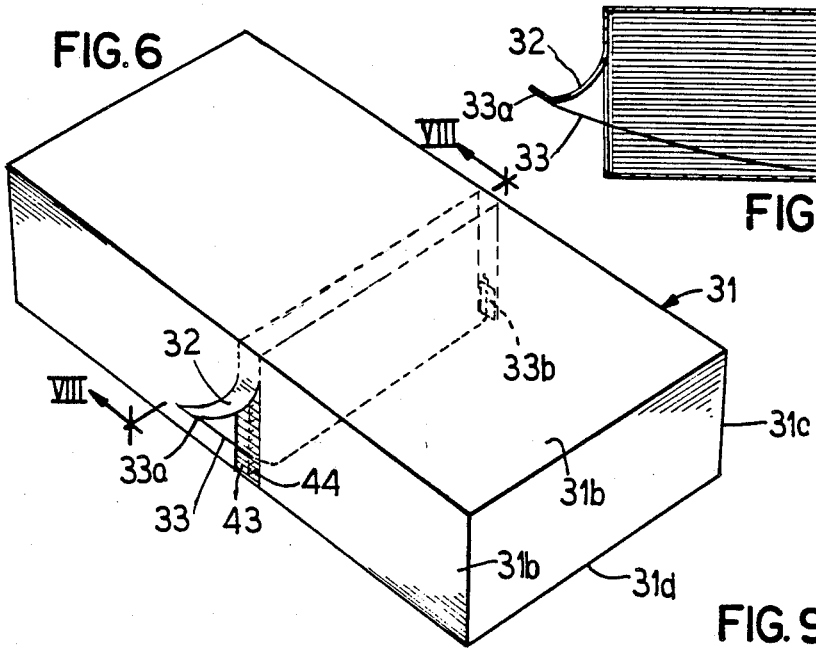
FIG. 6 is a perspective view of still another form of the invention.
Figure 7:
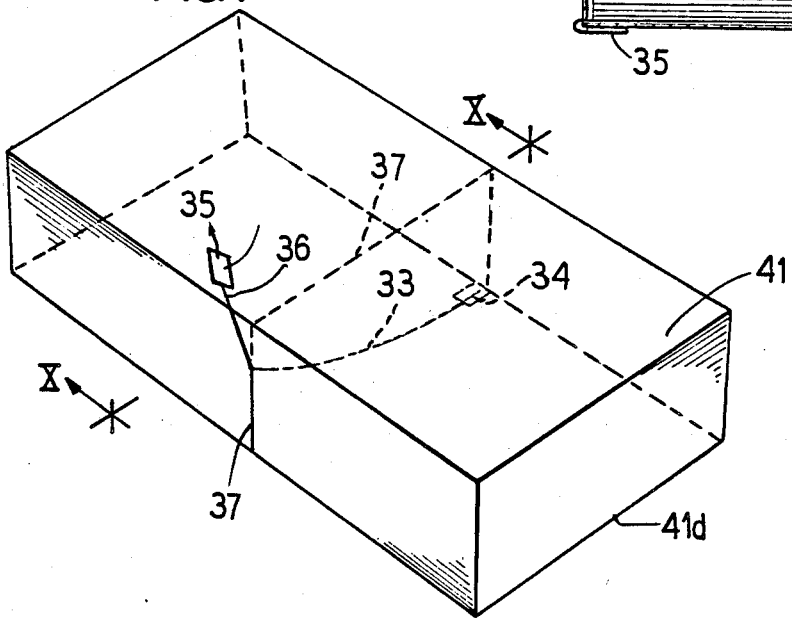
FIG. 7 is a perspective view of a further form of the invention.
Figure 10:
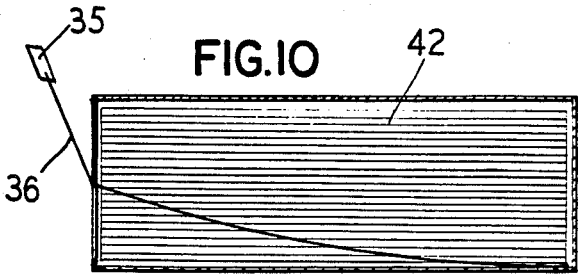
FIG. 10 is a sectional view similar to FIG. 9, taken along line X—X of FIG. 7 and illustrating the process of separating the bags and opening the carton.

FIGS. 6 and 7 show a means for separating or cutting the tops of the bags, and in the arrangement shown the carton is separated into its sections and the bags are cut in the same operation.

In the arrangement of FIG. 6, a carton 31 is shown with stacks 43 and 44 of bags therein. The carton is of a size so that the bags are snuggly located therein as with the arrangement of FIGS. 1 and 2.

A tear strip 32 extends along three faces 31*a*, 31*b* and 31*c* of the carton. A fold line will exist on the fourth face 31*d* at the location of the tear strip.

The tear strip is uniquely constructed in that it is provided with a severing or cutting thread 33 extending within the carton along beneath the stacks of bags. A lead end 33*a* of the thread is connected to the tear strip 32. The other end 33*b* of the thread is anchored within the carton to the interior lower edge of the wall 31*c*.

Figure 8:
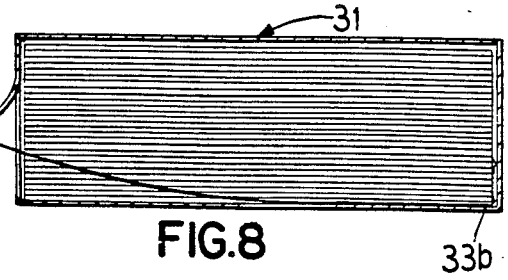
FIG. 8 is a sectional view taken substantially along line VIII—VIII of FIG. 6 showing the interior of the container.

When the user is ready to use the bags, he pulls upwardly on the tear strip 32 thus pulling the thread 33 upwardly and drawing it through between the tops of the bag stacks 43 and 44 thus cutting the tops of the bags and separating them. A full removal of the tear strip 32 will pull the severing thread 33 completely between the stacks of bags thoroughly separating them. Then when the carton is bent back in its two sections about the fold line, the tops of the bags will project upwardly so they generally will have the appearance illustrated in FIG. 4. The thread will be discarded along with the tear strip 32, out of the way. The operation of the cutting thread in being drawn upwardly is illustrated in FIG. 8 as a cutting tension is applied to the thread 33 simultaneously with the tear strip 32 being pulled upwardly by being grasped at its lead end 33*a*. The removal of the tear strip and the upward pulling of the cutting thread can be done quickly with a mere flick of the wrist and the remaining carton sections bent back of each other to provide the dispensing container with the bags held oriented therein ready for individual withdrawal.

Figure 9:
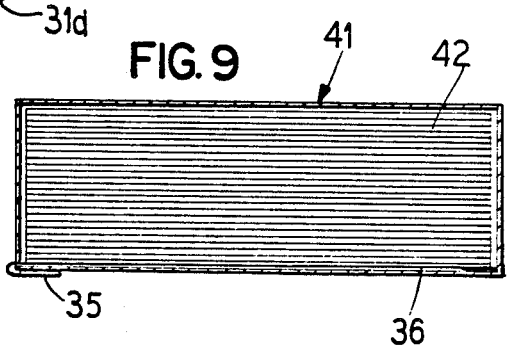
FIG. 9 is a vertical sectional view of the container before it is opened taken substantially along line X—X of FIG. 7.

In the arrangement of FIG. 7, the broad tear strip is omitted and a cutting thread 36 not only separates the bags but also separates the sections of a container 41. The container and the bags therein have the same construction as with the arrangement of FIGS. 1, 2 and 6 and the bags will be lightly joined at their tops such as by a perforate line as shown at 16*a* in FIG. 5. The cutting thread 36 is anchored within the carton at 34. The other end of the cutting thread has a tab 35 which projects exteriorly of the carton in a location to be easily gripped as illustrated in FIG. 9. As the user grips the tab 35 and pulls it upwardly, the cutting thread severs the carton along the line 37, FIG. 7. When this is completed, the thread 36 can be completely pulled from the carton and discarded and the carton bent open about a fold line on the back surface 41*d* which is in alignment with the line of severance 37 and the carton will then essentially have the appearance of FIG. 4. Inasmuch as the severance line 37 is at a single location so that material is not removed as is the case with the tear strip, the bags normally will not project beyond the top edge of the two sections of the carton. However, in some cases stacks of bags may be used which slightly overlap at their top edges and in that case, the bag tops will project. It will be understood that the tear thread 36 can be used with interconnected bags or with bags with stacks that merely touch and are not interconnected in which case the thread 36 will serve only to cut the container 41 into sections.

In operation a user receives the carton such as shown in the form in which it appears when shipped as illustrated in FIGS. 1, 2, 6 or 7. The user pulls the tear strip from the container, and in the arrangement of FIG. 6 also pulls the cutting thread 33, and in the arrangement of FIG. 7, only pulls the cutting thread 36. This separates the stacks of bags within the container and also separates the container into sections so that it can be folded open to expose the stacks of bags and provide a handy dispensing container for ready removal of the bags.

We claim in our invention:

1. A container dispenser assembly comprising in combination:

an elongate rectangular container dispenser having continuous flat side walls and defining opposte end sections of the container;

first and second stacks of flat dispensable bags with one stack in one end section of the container and a second stack in the other end section of the container with the stacks located in parallel relationship and their top ends adjacent each other at the meeting of the sections of the container with the container holding the bags in their stacked relationship;

a fold line extending across one wall of the container in alignment with the top ends of the bags; and means defining parallel tear lines with a tear strip therebetween and extending across the remaining container walls at the location of the top ends of the bags and joining the ends of the fold line so that the container walls may be separated by tearing said strip along the tear lines to expose the top ends of the bags to extend exposed a substantial distance above the tear lines when the container sections are folded toward one another at said fold line for facilitating individual removal of the bags from the container sections by grasping the upwardly extending exposed ends of the bags.

2. A container dispenser assembly constructed in accordance with claim 1:

wherein the bags are formed of a relatively slippery plastic so that the bags may be readily withdrawn from the sections of the container by grasping their top ends and removing them.

3. A container dispenser assembly constructed in accordance with claim 1:

wherein the top ends of the bags of one of the stacks are joined to the top ends of the individual bags of the other stack by frangible lines and the ends of the bags are separated by the time the sections of the container are folded along the fold line.

4. A container dispenser assembly constructed in accordance with claim 3, including a thread anchored at one end to the container adjacent to one end of the tear strip, the thread being anchored at a second end to a second end of the tear strip and the thread being generally aligned with said frangible lines so that when the tear strip is separated from the container section by tearing it from the tear lines starting at said second end of the strip, the thread will effect separation of the tops of the bags along said frangible lines.

5. A container dispenser assembly constructed in accordance with claim 1:

including means for holding the sections of the folded walls of the container together on each side of the fold line after the container has been separated along the frangible line.

6. A container dispenser assembly constructed in accordance with claim 5:

wherein said means is in the form of adhesive tape located between walls of the container sections.

* * * * *